US010505312B2

(12) United States Patent
Johannes et al.

(10) Patent No.: US 10,505,312 B2
(45) Date of Patent: Dec. 10, 2019

(54) HOT MATE CONTACT SYSTEM

(71) Applicant: Smiths Interconnect Americas, Inc., Kansas City, KS (US)

(72) Inventors: Richard Johannes, Trabuco Canyon, CA (US); John Anderson, Hemel Hempstead (GB)

(73) Assignee: Smiths Interconnect Americas, Inc., Kansas City, KS (US)

( * ) Notice: Subject to any disclaimer, the term of this patent is extended or adjusted under 35 U.S.C. 154(b) by 0 days.

(21) Appl. No.: 15/891,113

(22) Filed: Feb. 7, 2018

(65) Prior Publication Data

US 2019/0245298 A1 Aug. 8, 2019

(51) Int. Cl.

| | |
|---|---|
| ***H01R 13/53*** | (2006.01) |
| ***H01R 13/20*** | (2006.01) |
| ***H01R 13/66*** | (2006.01) |
| ***H01R 13/639*** | (2006.01) |
| ***H01R 13/631*** | (2006.01) |

(52) U.S. Cl.

CPC ..... *H01R 13/53* (2013.01); *H01R 13/20* (2013.01); *H01R 13/631* (2013.01); *H01R 13/639* (2013.01); *H01R 13/6625* (2013.01)

(58) Field of Classification Search

CPC ..... H01R 13/03; H01R 13/035; H01R 43/16; H01R 13/53; H01R 13/20; H01R 13/6625; H01R 13/639; H01R 13/631

USPC ..... 439/887, 886, 620.01–620.25

See application file for complete search history.

(56) References Cited

U.S. PATENT DOCUMENTS

| | | | | |
|---|---|---|---|---|
| 4,747,783 | A * | 5/1988 | Bellamy | H01R 13/03 200/268 |
| 4,925,394 | A * | 5/1990 | Hayashi | H01H 1/021 439/86 |
| 6,007,390 | A * | 12/1999 | Cheng | C23C 14/0688 428/673 |
| 6,102,742 | A | 8/2000 | Daly | |
| 6,659,783 | B2 | 12/2003 | Copper et al. | |
| 2002/0032963 | A1 * | 3/2002 | Lindegren | A61N 1/056 29/868 |
| 2004/0239355 | A1 * | 12/2004 | Kazama | C23C 28/023 324/755.05 |
| 2006/0105641 | A1 * | 5/2006 | Rehbein | H01H 1/02 439/886 |
| 2011/0100825 | A1 * | 5/2011 | Heinrichsdorff | C25D 7/00 205/50 |
| 2013/0344753 | A1 * | 12/2013 | Goehler | B22D 19/14 439/887 |

(Continued)

*Primary Examiner* — Gary F Paumen

(74) *Attorney, Agent, or Firm* — Snell & Wilmer LLP

(57) ABSTRACT

Methods, systems, and apparatus for reducing electrical arcing in a connector. The connector includes a pin contact having a pin tip end and a pin base end, the pin contact at the pin base end being made of a first material having a first resistance and the plug contact at the tip end being made of a second material having a second resistance greater than the first resistance. The connector also includes a socket contact configured to receive the pin contact, and the socket contact configured to establish an electrical connection with the pin contact to transfer electrical power, the second material of the pin contact configured to prevent electrical arcing by suppressing electrical voltage when the pin contact is mated or unmated from the socket contact while electrical power is being transferred.

17 Claims, 4 Drawing Sheets

(56) References Cited

U.S. PATENT DOCUMENTS

2015/0214648 A1* 7/2015 Ju ..... H01R 13/03
439/248
2016/0344125 A1* 11/2016 Thorner ..... H01R 13/03

* cited by examiner

HOT MATE CONTACT SYSTEM

BACKGROUND

1. Field

This specification relates to a system and a method for a connector capable of powered mating and unmating.

2. Description of the Related Art

A connector may include a plug and a receptacle, each having contacts. Contacts carrying significant amounts of power may cause an electrical arc when disconnected while electrical power is transmitted from one contact to the other. The electrical arc may cause damage to components of the connector, and over time, the damage may cause the connector to fail or work less efficiently.

Conventional systems may shut off the power being transferred from one contact to another when unmating, in order to avoid electrical arcing. However, these conventional systems require many more components and control systems than the plug and the receptacle.

SUMMARY

What is described is a connector capable of reducing electrical arcing between a pin contact and a socket contact. The connector includes a pin contact having a pin tip end and a pin base end, the pin contact at the pin base end being made of a first material having a first resistance and the plug contact at the tip end being made of a second material having a second resistance that is greater than the first resistance. The connector also includes a socket contact configured to receive the pin contact, and the socket contact configured to establish an electrical connection with the pin contact to transfer electrical power, the second material of the pin contact configured to prevent electrical arcing by suppressing electrical voltage when the pin contact is mated or unmated from the socket contact while electrical power is being transferred.

Also described is a pin contact corresponding to a socket contact configured to receive the pin contact. The pin contact includes a pin base end being made of a first material having a first resistance. The pin contact also includes a pin tip end being made of a second material having a second resistance greater than the first resistance, the second material of the plug contact configured to prevent electrical arcing by suppressing electrical voltage when the pin contact is mated or unmated from the socket contact while electrical power is being transferred.

Also described is a connector capable of reducing electrical arcing between a pin contact and a socket contact. The connector includes a pin contact having a contact portion and a resistive portion, the contact portion being made of a first material having a first resistance and the resistive portion being made of a second material having a second resistance greater than the first resistance. The connector also includes a socket contact configured to receive the pin contact, and the socket contact configured to establish an electrical connection with the pin contact to transfer electrical power, the second material of the pin contact configured to prevent electrical arcing by suppressing electrical voltage when the pin contact is mated or unmated from the socket contact while electrical power is being transferred.

BRIEF DESCRIPTION OF THE DRAWINGS

Other systems, methods, features, and advantages of the present invention will be apparent to one skilled in the art upon examination of the following figures and detailed description. Component parts shown in the drawings are not necessarily to scale, and may be exaggerated to better illustrate the important features of the present invention.

DETAILED DESCRIPTION

Disclosed herein are apparatuses, systems, and methods for a system for preventing arcing when mating or unmating a pin contact from a socket contact when electrical power is being communicated between the pin contact and the socket contact. The pin contact may be part of a plug portion of a connector and the socket contact may be part of a receptacle portion of a connector.

Figure 1:
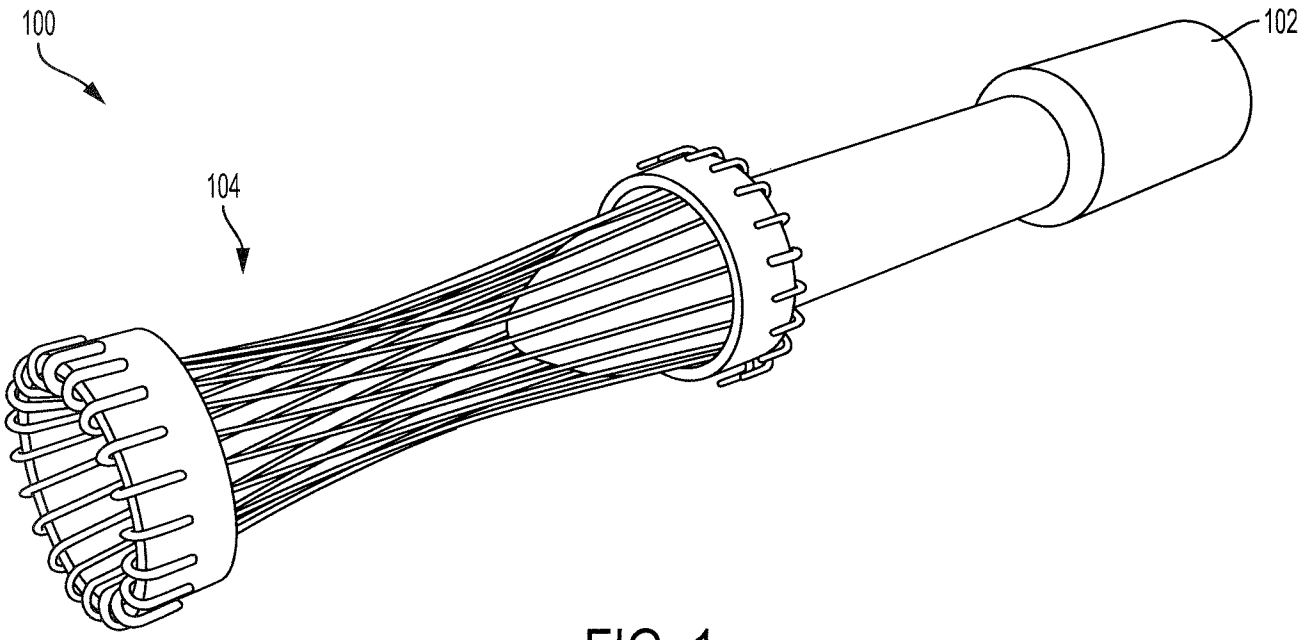
FIG. 1 is a perspective view of a connector assembly, according to some embodiments of the invention.

FIG. 1 illustrates a perspective view of the connector assembly. The connector 100 includes a pin contact 102 and a socket contact 104. The pin contact 102 and the socket contact 104, when connected, provide a connection for transferring power. In some embodiments, the power source is connected to the pin contact 102, and a device to be powered is connected to the socket contact 104. In other embodiments, the power source is connected to the socket contact 104, and the device to be powered is connected to the pin contact 102.

The pin contact 102 may be a generally cylindrically shaped device configured to be received by the socket contact 104. The pin contact 102 may have a tapered tip to facilitate connection and alignment when engaged with the socket contact 104. The socket contact 104, while pictured as a hyperboloid socket, may be any type of socket configured to receive the pin contact 102 and establish an electrical connection with the pin contact 102.

The pin contact 102 may be a part of a first connector housing and the socket contact 104 may be a part of a second connector housing. The first and second connector housings may be configured to engage with each other. In some embodiments, a cover or a protective cavity for the pin contact 102 and the socket contact 104 is formed when the first and second connector housings are engaged.

The electrical power provided to the pin contact 102 or the socket contact 104 may be established before or after the pin contact 102 and the socket contact 104 are mated. When electrical power is provided before the pin contact 102 and the socket contact 104 are mated, electrical arcing may occur when the pin contact 102 is in sufficient proximity to the socket contact 104. In addition, when electrical power is maintained while the pin contact 102 is being unmated from the socket contact 104, electrical arcing may occur as the pin contact 102 separates from the socket contact 104 but remains in sufficient proximity. When electrical power is provided after the pin contact 102 and the socket contact 104 are mated, and when electrical power is disconnected before the pin contact 102 and the socket contact 104 are unmated, there is no risk of electrical arcing. While an ideal operation is to disconnect electrical power before unmating the pin contact 102 and the socket contact 104, in practice, the pin contact 102 may be removed from the socket contact 104 without disconnecting electrical power flowing through the system 100.

Electrical arcing may damage the pin contact 102 and/or the socket contact 104. Damage to the pin contact 102 and/or the socket contact 104 may result in reduced or impaired performance and eventual replacement of the components. The damage to the pin contact 102 and/or the socket contact 104 may not be immediately obvious as a source of reduced or impaired performance of the electrical system in which the pin contact 102 and the socket contact 104 are used. Accordingly, having a reliable pin contact 102 and socket contact 104 used in the electrical system is advantageous, important and valuable.

Figure 2:
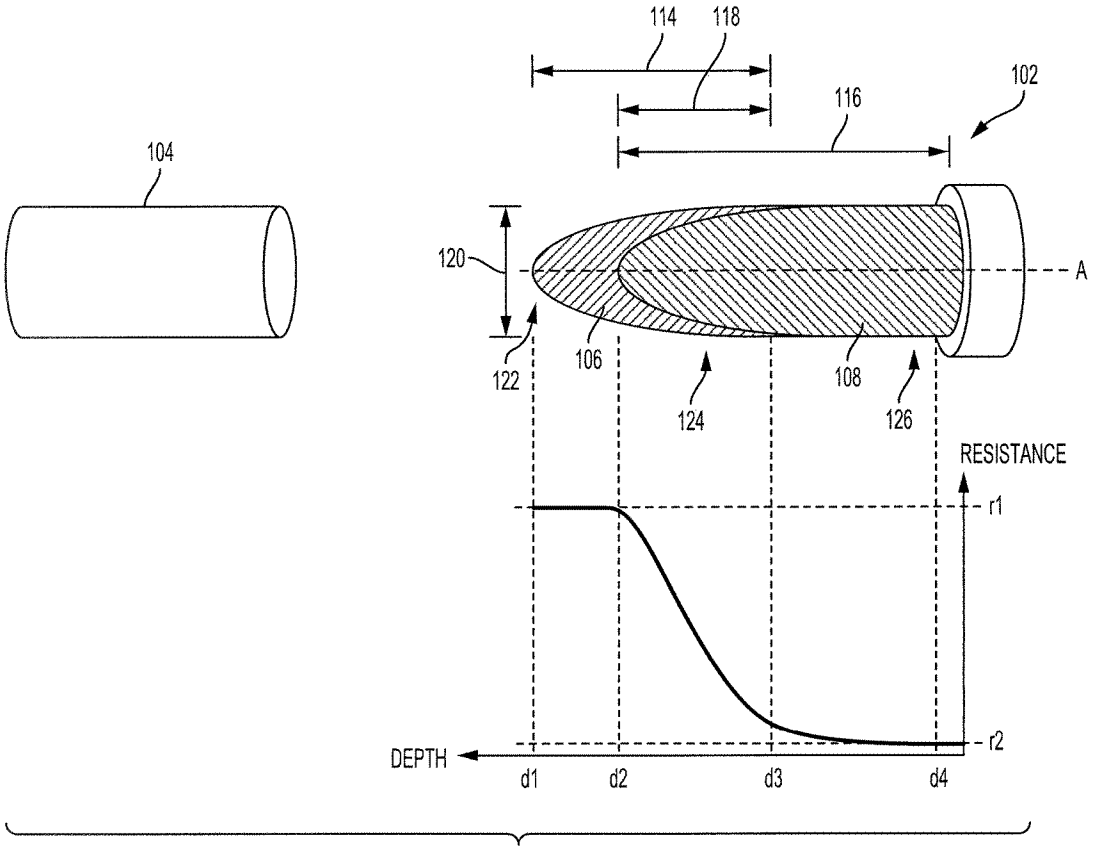
FIG. 2 is a side cross-sectional view of the connector assembly, according to some embodiments of the invention.
Figure 3:
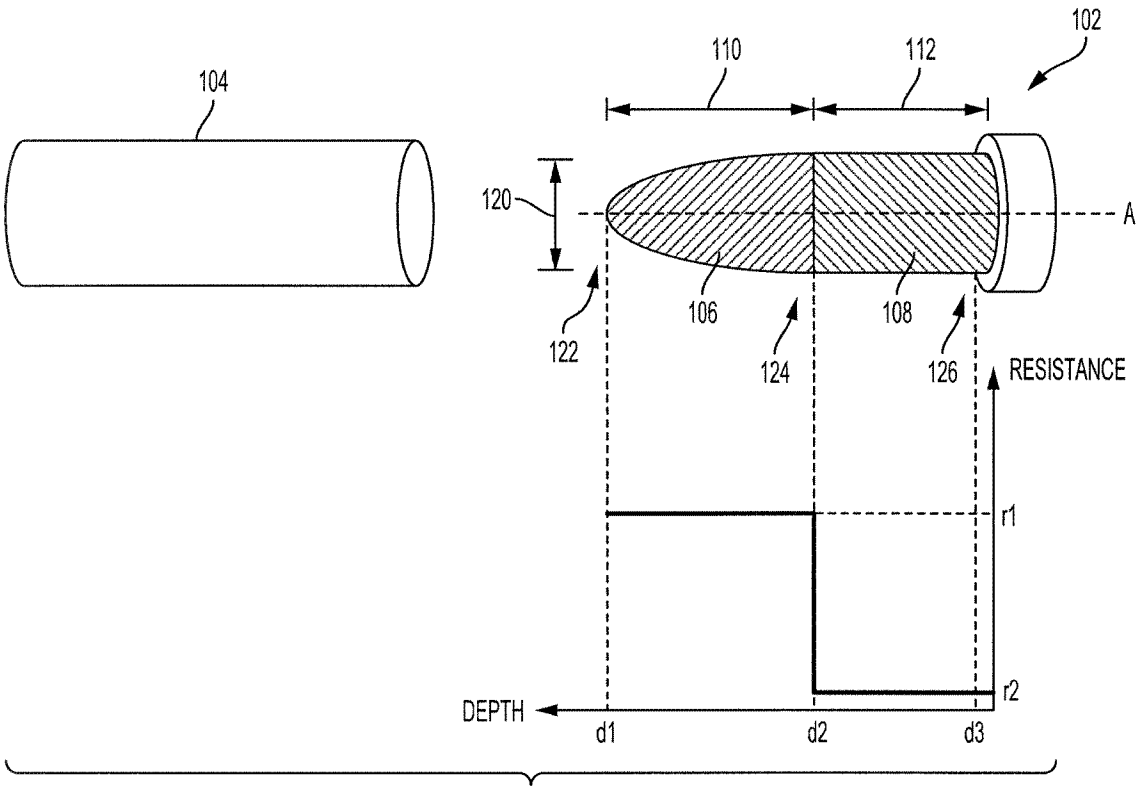
FIG. 3 is a side cross-sectional view of the connector assembly, according to some embodiments of the invention.
Figure 4:
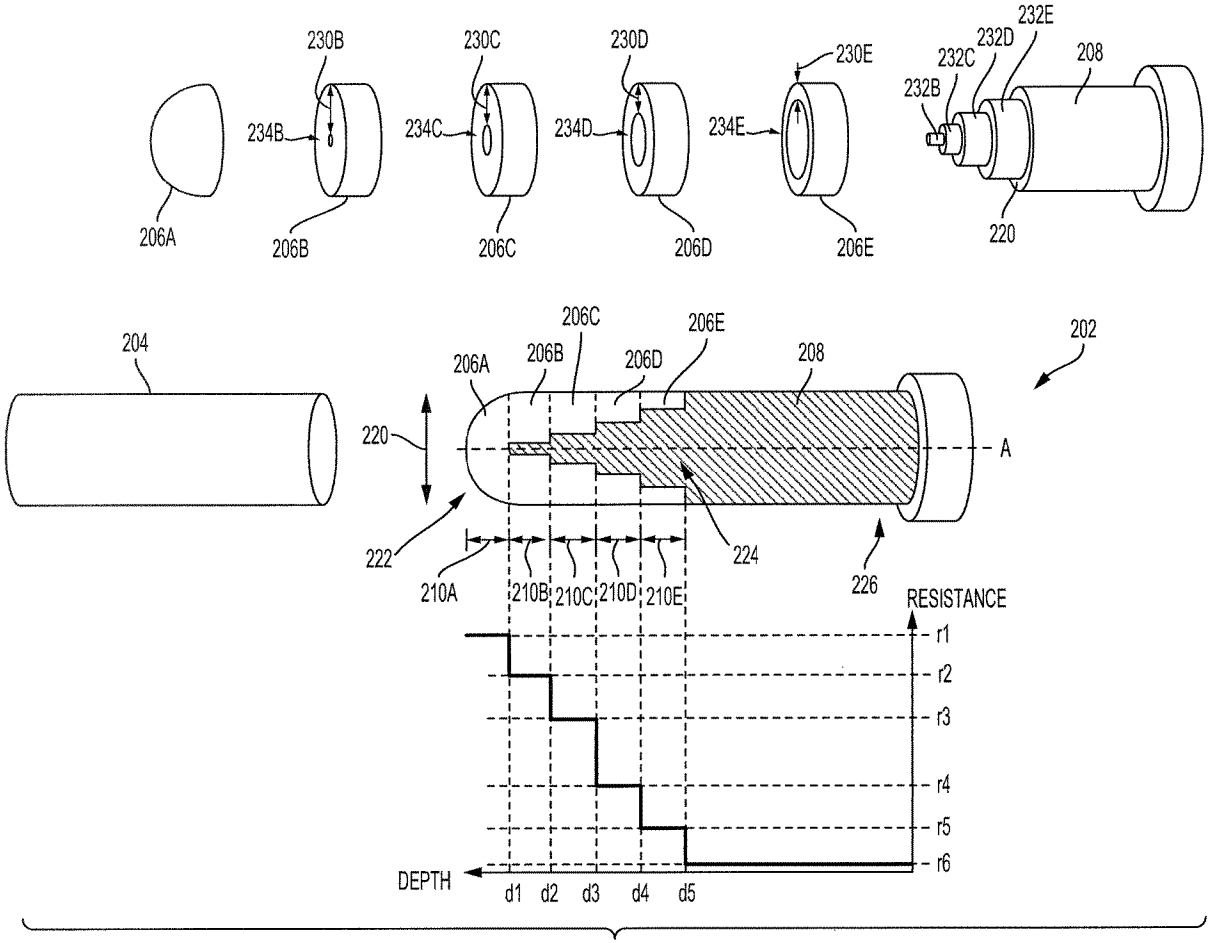
FIG. 4 is a side cross-sectional view of the connector assembly, according to some embodiments of the invention.

The pin contact 102, as shown in FIGS. 2-4, may include a resistive portion which provides sufficient resistance to suppress the electrical arcing. In order for an electrical arc to form, a sufficient level of voltage is transmitted between the pin contact 102 and the socket contact 104. However, if a resistive element is located between the pin contact 102 and the socket contact 104 during powered mating and/or unmating, electrical arcing may be suppressed. The characteristics and dimensions of the pin contact 102 may vary based on the anticipated use of the pin contact 102 and the socket contact 104. In particular, the anticipated amount of voltage to be suppressed may affect various characteristics and dimensions of the pin contact 102. For example, the material used for the resistive element, the dimensions and thickness of the resistive element, and the shape of the resistive element may be affected by the amount of voltage to be suppressed. For example, when the anticipated voltage to be transmitted is 100V, the resistive element may be thicker than when the anticipated voltage to be transmitted is 20V, as the amount of voltage to be suppressed is greater.

FIG. 2 illustrates a length-wise cross-section of the pin contact 102 according to some embodiments of the invention. The pin contact 102 may have two portions—a resistive portion 106 and a contact portion 108. In a conventional pin contact that is not designed to prevent electrical arcing, the entire pin contact may be the contact portion. The resistive portion 106 provides a resistive barrier or buffer to suppress the electrical voltage between the pin contact 102 and the socket contact 104, thus preventing electrical arcing during connection or disconnection under an electrical load.

The pin contact 102 extends along an axis A. The pin contact 102 has a pin width 120, and a pin tip end 122, a pin transition area 124, and a pin base end 126. The pin tip end 122 is in the resistive portion 106. Accordingly, at the pin tip end 122, the pin contact 102 is made entirely of the resistive material. The pin base end 126 is in the contact portion 108. Accordingly, at the pin base end 126, the pin contact 102 is made entirely of the contact material. The pin transition area 124 has an overlap of the resistive portion 106 and the contact portion 108. Accordingly, at the pin transition area, the pin contact 102 is made of partially the resistive material and partially of the contact material. In one embodiment, the pin contact 102 in the pin transition area 124 is made of the contact material surrounded by the resistive material. The resistive portion 106 may have a resistive portion length 114, the contact portion 108 may have a contact portion length 116, and the pin transition area 124 may have a transition length 118.

In various embodiments, the pin contact 102 may have one, two or three portions: a first portion where the pin contact 102 is made of only the contact material (proximal to the pin base end 126), a second portion where the pin contact 102 is made of the contact material surrounded by the resistive material (in the pin transition area 124), and a third portion where the pin contact 102 is made of only the resistive material (proximal to the pin tip end 122). The first portion may have a length that is the difference between the contact portion length 116 and the transition length 118. The second portion may have a length that is the transition length 118. The third portion may have a length that is the difference between the resistive portion length 114 and the transition length 118.

The resistive portion 106 has a tapered geometry as the resistive portion 106 transitions to the contact portion 108. This tapered geometry results in a gradual decrease in resistance provided by the resistive portion 106 as the pin contact 102 is entered further into the socket contact 104. This gradual decrease in resistance is illustrated in the graph in FIG. 2. At depth d1, when the pin contact 102 is beginning to be inserted into the socket contact 104, the resistance r1 is relatively high. As the pin contact 102 is further inserted into the socket contact 104, the resistance drops, as shown by the graph between depths d2 to d3. Between the depths d2 to d3, the resistive portion 106 surrounds the contact portion 108, but the thickness of the resistive portion 106 around the contact portion 108 gradually becomes narrower as the depth moves from d2 to d3, thus reducing the resistance provided by the resistive portion 106. When the pin contact 102 is fully inserted in the socket contact 104 at depth d4, a level of resistance r2 similar to that of a conventional pin contact having no resistive portion 106 may be achieved.

While the tip of the contact portion 108 is illustrated as having a curved tip, the tip of the contact portion 108 may be flat or may terminate at a point, or may have any other suitable shape.

The exact dimensions of the pin width 120, the resistive portion length 114, the transition length 118, the contact portion length 116, and the exact geometry of the pin contact 102 may vary based on the materials used and the context for the pin contact 102 and the socket contact 104. For example, as the potential maximum electrical load increases, a more gradual resistance profile may be used. In another example, when the potential maximum electrical load is relatively small, a more abrupt (and possibly easier and/or more cost efficiently manufactured) profile may be used.

The contact material used for the contact portion 108 may be any conductive material used for pin contacts, such as one or more of copper, copper alloy, gold, silver, and/or nickel. The resistive material used for the resistive portion 106 may be any material which provides improved resistance compared to the contact material used for the contact portion 108. In addition, the resistive material used for the resistive portion 106 may additionally be a relatively tenacious or durable material relatively resistant to erosion from mating and unmating with the socket contact 104. For example, the resistive material used for the resistive portion 106 may be silicon carbide, titanium nitride, gallium nitride, or any other ceramic or ceramic-like material with a conductive slurry. Doped ceramics may also be used.

The resistive portion 106 may also provide additional benefits to the pin contact 102, such as increasing durability of the pin contact 102 and preventing accidental shocks to users. Conventionally, plastic caps may be used to "finger proof" the connector to prevent accidental shocks, but the resistive portion 106 may also serve to prevent accidental shocks.

The resistive portion 106 may be applied in coatings of layers until the desired dimensions and thicknesses are achieved. The layers may vary in thickness based on the location of the pin contact 102 where the resistive material is applied. Alternatively, the resistive portion 106 may be cast and attached to the contact portion 108 via an adhesive or other bonding technique. The dimensions of the resistive portion 106 may be incrementally adjusted to tune the pin contact 102 to have the exact performance characteristics appropriate for the context in which it is used. In some embodiments, a laser is used to trim the resistive portion 106 and/or the contact portion 108 of the pin contact 102 to tune the resistance of the system.

Conventionally, an electronic component may be integrated into the circuit at an upstream and/or downstream location from the connector, and the electronic component controls the current and voltage to prevent electrical arcing. However, these solutions may be more expensive and may require more maintenance than the system described herein. The resistive portion 106 of the pin contact 102 is instead a fully integrated part of the system and does not require maintenance or additional components or power to operate.

Also, conventionally, sacrificial materials, such as plastic have been used in connectors to suppress electrical arcing. In these conventional systems, the electrical arc vaporizes the sacrificial materials located on the pin contact, and a gas is created, which suppresses the electrical arc. However, these solutions require monitoring of the pins to determine whether they should be replaced when the sacrificial materials have been compromised. When the proper maintenance is not performed, these conventional solutions are as vulnerable to electrical arcing as a system with no protections at all. By contrast, the resistive portion 106 of the pin contact 102 described herein have a significantly longer lifespan compared to conventional pin contacts.

While the resistive portion 106 is described herein as having an increased resistance compared to the contact portion 108, the resistive portion 106 may also be described as having a lower conductivity as compared to the contact portion 108. In some embodiments, the conductivity of the resistive portion 106 is non-zero, allowing for the resistive portion 106 to conduct electricity, but at a significantly lower rate than the contact portion 108.

FIG. 3 illustrates a cross-section of the pin contact 102 according to some embodiments of the invention. The pin contact 102 may have two portions—a resistive portion 106 and a contact portion 108. The resistive portion 106 provides a resistive barrier or buffer to suppress the electrical voltage between the pin contact 102 and the socket contact 104, thus preventing electrical arcing. The resistive portion 106 has a resistive portion length 110 and the contact portion 108 has a contact portion length 112.

The pin contact 102 has a pin width 120, and a pin tip end 122, a pin transition area 124, and a pin base end 126. Unlike the pin contact 102 in FIG. 2, the resistive portion 106 immediately transitions to the contact portion 108, with no overlap of the resistive portion 106 and the contact portion 108. Accordingly, for the entire resistive portion length 110, from the pin tip end 122 to the pin transition area 124, the pin contact 102 is made of the resistive material. In addition, for the entire contact portion length 112, from the pin transition area 124 to the pin base end 126, the pin contact 102 is made entirely of the contact material. The pin transition area 124 is effectively a plane and has no overlap of the resistive portion 106 and the contact portion 108.

The resistive portion 106 abruptly transitions to the contact portion 108. This immediate or abrupt geometry results in a sudden decrease in resistance provided by the resistive portion 106 as the pin contact 102 is entered deeper into the socket contact 104. This abrupt decrease in resistance is illustrated in the graph in FIG. 3. At depth d1, when the pin contact 102 is beginning to be inserted into the socket contact 104, the resistance r1 is at a relatively high and constant level. The resistance r1 is maintained until the pin contact 102 is inserted to a depth d2. At depth d2, the resistance falls to a substantially constant level r2 until the pin contact 102 is fully inserted at a depth d3.

The exact dimensions of the pin width 120, the resistive portion length 110, the contact portion length 112, and the exact geometry of the pin contact 102 may vary based on the materials used and the context for the pin contact 102 and the socket contact 104.

FIG. 4 illustrates a cross-section of the pin contact 202 according to some embodiments of the invention. The pin contact 202 may have two portions—a resistive portion 206 and a contact portion 208. The resistive portion 206 provides a resistive barrier or buffer to suppress the electrical voltage between the pin contact 202 and the socket contact 204, thus preventing electrical arcing. The resistive portion 206 has a resistive portion length 210, which is a sum of the lengths 210A-210E.

The pin contact 202 has a pin width 220, a pin tip end 222, a pin transition area 224, and a pin base end 226. Like the pin contact 102 in FIG. 2, the resistive portion 206 gradually transitions to the contact portion 208, with an overlap of the resistive portion 206 and the contact portion 208. However, unlike the gradual transition of the pin contact 102 of FIG. 2, the transition from the resistive portion 206 to the contact portion 208 of pin contact 202 is in incremental steps.

The resistive portion 206 may be made of multiple circular segments 206A-206E. The first segment 206A may be made entirely of the resistive material and has a length 210A. The first segment 206A may be shaped like a semi-sphere, unlike the other segments 206B-206E, which are annular.

The second segment 206B may have a hole or aperture 234B. The second segment 206B may be annular and have an annulus thickness 230B. The second segment 206B has a length 210B. The hole or aperture 234B of the second segment may be configured to fit around a first contact segment 232B of the contact portion 208.

The third segment 206C may have a hole or aperture 234C. The hole or aperture 234C may be wider than the hole or aperture 234B of the second segment 206B. The third segment 206C may be annular and have an annulus thickness 230C. The third segment 206C has a length 210C. The hole or aperture 234C of the third segment may be configured to fit around a second contact segment 232C of the contact portion 208. As the annulus thickness 230C is less than the annulus thickness 230B of the second segment 206B, the resistance provided by the third segment 206C may be less than the resistance provided by the second segment 206B.

The fourth segment 206D may have a hole or aperture 234D. The hole or aperture 234D may be wider than the hole or aperture 234C of the third segment 206C. The fourth segment 206D may be annular and have an annulus thickness 230D. The fourth segment 206D has a length 210D. The hole or aperture 234D of the fourth segment may be configured to fit around a third contact segment 232D of the contact portion 208. As the annulus thickness 230D is less than the annulus thickness 230C of the third segment 206C, the resistance provided by the fourth segment 206D may be less than the resistance provided by the third segment 206C.

The fifth segment 206E may have a hole or aperture 234E. The hole or aperture 234E may be wider than the hole or aperture 234D of the fourth segment 206D. The fifth segment 206E may be annular and have an annulus thickness 230E. The fifth segment 206E has a length 210E. The hole or aperture 234E of the fifth segment may be configured to fit around a fourth contact segment 232E of the contact portion 208. As the annulus thickness 230E is less than the annulus thickness 230D of the fourth segment 206D, the resistance provided by the fifth segment 206E may be less than the resistance provided by the fourth segment 206D.

The stepped or incremental change in resistance provided by the segments 206A-206E is illustrated in the graph shown in FIG. 4. Until depth d1, when the pin contact 202 is beginning to be inserted into the socket contact 204, the resistance r1 is at a relatively high level. As the pin contact 202 is further inserted into the socket contact 204, between depths d1 to d2, the resistance falls to a lower resistance r2. As the pin contact 202 is further inserted into the socket contact 204, between depths d2 to d3, the resistance falls to an even lower resistance r3. As the pin contact 202 is further inserted into the socket contact 204, between depths d3 to d4, the resistance falls to a lower resistance r4. As the pin contact 202 is further inserted into the socket contact 204, between depths d4 to d5, the resistance falls to a lower resistance r5. When the pin contact 202 is fully inserted into the socket contact 204, the resistance r6 is at a level comparable with a pin contact that does not have a resistive portion 206.

The segments 206A-206E may be comprised of multiple segments connected together by an adhesive, or the segments 206A-206E may be a single piece that is machined from a single piece of resistive material or a single piece that is created by applying layers of the resistive material onto the contact portion 208 of the pin contact 202.

The exact dimensions of the pin width 220, the segment length (collectively the resistive portion length 210), the segment annulus thickness 230, the number of segments, and the exact geometry of the pin contact 202 may vary based on the materials used and the context for the pin contact 202 and the socket contact 204.

In an example situation, when the pin contact and socket contact are used in an electric vehicle, for charging the electric vehicle, the power transmitted may be, for example, 600V at 300 A. When there is a powered unmating of the pin contact and the socket contact, a large amount of capacitive charge may be present in the system, and sufficient resistance is required to clamp the voltage to prevent an electrical arc. To properly address the relatively large amount of capacitive charge, a pin contact 102 having a profile with a more gradual increase in resistance may be appropriate, such as those shown in FIGS. 2 and 4.

In another example situation, when the pin contact and socket contact are used in the backplane of a control system of an airplane, the power transmitted may be, for example, 24V at 5A. When there is a powered unmating of the pin contact and the socket contact, only a relatively small amount of voltage may need to be clamped. Accordingly, a pin contact 102 having a profile with an abrupt increase in resistance may be used, such as those shown in FIG. 3.

Exemplary embodiments of the methods/systems have been disclosed in an illustrative style. Accordingly, the terminology employed throughout should be read in a non-limiting manner. Although minor modifications to the teachings herein will occur to those well versed in the art, it shall be understood that what is intended to be circumscribed within the scope of the patent warranted hereon are all such embodiments that reasonably fall within the scope of the advancement to the art hereby contributed, and that that scope shall not be restricted, except in light of the appended claims and their equivalents.

What is claimed is:

1. A connector comprising:

a pin contact having a pin tip end and a pin base end, the pin contact at the pin base end being made of a first material having a first resistance and the pin contact at the pin tip end being made of a second material, the second material being a semiconductor material and having a second resistance greater than the first resistance, the pin base end having a base end width and the pin tip end having a tip end width that is less than the base end width; and a socket contact configured to receive the pin tip end of the pin contact prior to receiving the pin base end of the pin contact, and the socket contact configured to establish an electrical connection with the pin contact to transfer electrical power, the second material of the pin contact configured to prevent electrical arcing by suppressing electrical voltage when the pin contact is mated or unmated from the socket contact while electrical power is being transferred.

2. The connector of claim 1, wherein the pin contact extends along an axis, and the pin contact has a first portion, a second portion, and a third portion arranged along the axis, the first portion being made entirely of the first material, the second portion being made of the first material and the second material, the second material surrounding the first material in the second portion, and the third portion being made entirely of the second material, the second portion located between the first portion and the third portion.

3. The connector of claim 1, wherein the pin contact extends along an axis and has a first portion and a second portion arranged along the axis, the first portion being made entirely of the first material and the second portion being made entirely of the second material.

4. The connector of claim 1, wherein the semiconductor material is at least one of silicon carbide, titanium nitride, or gallium nitride.

5. The connector of claim 1, wherein the socket contact is a hyperboloid socket.

6. The connector of claim 1, wherein the pin base end is made of only the first material through a cross-section of the pin base end, the first material having the first resistance.

7. A pin contact corresponding to a socket contact configured to receive the pin contact, the pin contact comprising:

a pin base end being made of a first material having a first resistance and having a base end width; and a pin tip end being made of a second material, the second material being a semiconductor material and having a second resistance greater than the first resistance, the second material of the pin contact configured to prevent electrical arcing by suppressing electrical voltage when the pin contact is mated or unmated from the socket contact while electrical power is being transferred, the pin tip end having a tip end width that is less than the base end width, and the pin tip end being configured to be received by the socket contact before the pin base end is received by the socket contact.

8. The pin contact of claim 7, wherein the pin contact extends along an axis, and the pin contact has a first portion, a second portion, and a third portion arranged along the axis, the first portion being made entirely of the first material, the second portion being made of the first material and the second material, the second material surrounding the first material in the second portion, and the third portion being made entirely of the second material, the second portion located between the first portion and the third portion.

9. The pin contact of claim 7, wherein the pin contact extends along an axis, and the pin contact has a first portion and a second portion arranged along the axis, the first portion being made entirely of the first material and the second portion being made entirely of the second material.

10. The pin contact of claim 7, wherein the semiconductor material is at least one of silicon carbide, titanium nitride, or gallium nitride.

11. The pin contact of claim 7, wherein the pin base end is made of only the first material through a cross-section of the pin base end, the first material having the first resistance.

12. A connector comprising:

a pin contact having a contact portion and a resistive portion, the contact portion being made of a first material having a first resistance and the resistive portion being made of a second material, the second material being a semiconductor material and having a second resistance greater than the first resistance, the contact portion having a contact portion width and the resistive portion having a resistive portion width that is less than the contact portion width; and a socket contact configured to receive the resistive portion of the pin contact prior to receiving the contact portion of the pin contact, and the socket contact configured to establish an electrical connection with the pin contact to transfer electrical power, the second material of the pin contact configured to prevent electrical arcing by suppressing electrical voltage when the pin contact is mated or unmated from the socket contact while electrical power is being transferred.

13. The connector of claim 12, wherein the pin contact has a pin tip end and a pin base end, the resistive portion being proximal to the pin tip end and the contact portion being proximal to the pin base end, and wherein the resistive portion does not overlap with the contact portion.

14. The connector of claim 12, wherein the pin contact extends along an axis, and the pin contact has a first portion, a second portion, and a third portion arranged along the axis, the first portion being made entirely of the first material, the second portion being made of the first material and the second material, the second material surrounding the first material in the second portion, and the third portion being made entirely of the second material, the second portion located between the first portion and the third portion.

15. The connector of claim 14, wherein the contact portion is located in the first portion and the second portion, and the resistive portion is located in the second portion and the third portion.

16. The connector of claim 12, wherein the semiconductor material is at least one of silicon carbide, titanium nitride, or gallium nitride.

17. The connector of claim 12, wherein the contact portion is made of only the first material through a cross-section of the contact portion, the first material having the first resistance.

* * * * *